US005893277A

United States Patent [19]

Biagi

[11] Patent Number: 5,893,277

[45] Date of Patent: Apr. 13, 1999

[54] EARRING FASTENING SYSTEM

[76] Inventor: Kathalean M. Biagi, 1834 Shadyhill Ter., Winter Park, Fla. 32792

[21] Appl. No.: 08/815,838

[22] Filed: Mar. 12, 1997

[51] Int. Cl.[6] ..... A44C 7/00

[52] U.S. Cl. ..... 63/12; 24/707.6

[58] Field of Search ..... 63/12, 13; 24/707.6, 24/707.5, 707.2, 705, 706.6, 706.9

[56] References Cited

U.S. PATENT DOCUMENTS

| | | | |
|---|---|---|---|
| 3,789,850 | 2/1974 | Ford | 63/12 X |
| 4,139,993 | 2/1979 | Tucker . | |
| 4,501,050 | 2/1985 | Fountoulakis . | |
| 4,580,417 | 4/1986 | Sardelli . | |
| 4,630,453 | 12/1986 | Burkett . | |
| 4,829,788 | 5/1989 | DiDomenico . | |
| 4,901,409 | 2/1990 | Seidman . | |
| 5,018,365 | 5/1991 | Luceno | 63/12 |
| 5,154,068 | 10/1992 | DiDomenico . | |
| 5,375,433 | 12/1994 | Skalet . | |
| 5,454,829 | 10/1995 | Koland . | |
| 5,456,094 | 10/1995 | Greenwald | 63/12 |
| 5,669,239 | 9/1997 | Tobita | 63/12 |

FOREIGN PATENT DOCUMENTS

| | | |
|---|---|---|
| 2239781 | 7/1991 | United Kingdom . |
| 2249252 | 5/1992 | United Kingdom . |

*Primary Examiner*—Kien T. Nguyen

*Attorney, Agent, or Firm*—Allen, Dyer, Doppelt, Milbrath & Gilchrist, P.A.

[57] ABSTRACT

An earring assembly is provided that is comfortable to wear even when sleeping and is easily manipulable when it is desired to change the decorative portion of the earring. The snap-fit back portion has a front tube portion into which an earring post is insertable, a notch in the tube positioned and dimensioned to frictionally engage a corresponding notch in the tube portion. A flat disc affixed to the back end of the tube retains the back end of the back portion against entering the earlobe hole. In another embodiment a post guide is provided for insertion into the earlobe hole preparatory to inserting the tube from the back of the earlobe forward, aiding the placement of the tube. In yet another embodiment an extension piece is provided for lengthening the portion of the back that resides within the earlobe hole in order to achieve a custom fit.

1 Claim, 1 Drawing Sheet

EARRING FASTENING SYSTEM

BACKGROUND OF THE INVENTION

1. Field of the Invention

The present invention relates to ornamental jewelry, and, more particularly, to jewelry for pierced body parts, such as earrings.

2. Description of Related Art

Several types of fastening devices are known for attaching ornamental jewelry to pierced body parts, such as earrings for attachment to earlobes. Among these are conventional posts that typically are inserted from the front to the back of the earlobe and then are held in place by any of a variety of back pieces. In these types of fastener the back piece generally has a hole therethrough that is dimensioned to provide a friction fit between the back piece and the post. In addition, the post usually has a notch adjacent its back end that serves two purposes: (1) to provide the user with a perceptible indication that the post and back piece are sufficiently mated to keep the earring in place; and (2) to provide a slight barrier to the removal of the back piece once it has been pushed toward the front of the post past the notch.

Variations on the conventional earring attachment devices have been disclosed by Johnson (U.S. Pat. No. 4,195,492), Tucker (U.S. Pat. Nos. 4,139,993 and 4,242,886), Fountoulakis (U.S. Pat. No. 4,501,050), Sardelli (U.S. Pat. No. 4,580,417), Burkett (U.S. Pat. No. 4,630,453), Seidman (U.S. Pat. Nos. 4,901,409 and 4,928,367), Grier et al. (U.S. Pat. No. 4,771,613), Koland (U.S. Pat. No. 5,454,829), and Greenwald (U.S. Pat. No. 5,456,094).

Several problems still exist in the known devices for affixing ornamental jewelry such as earrings to a pierced body part. For example, none of the known devices is comfortable for wearing while sleeping. In addition, a certain amount of digital acuity is required for inserting the post and affixing the back thereto. Such acuity is lacking in some individuals, either owing to aging or to a physical infirmity.

SUMMARY OF THE INVENTION

It is therefore an object of the present invention to provide an improved back for affixing ornamental jewelry to a pierced body part.

It is a further object to provide such a back that affords increased comfort to the wearer.

It is another object to provide such a back that can remain in place while interchanging decorative ornaments on an opposite side of the pierced site.

It is an additional object to provide a guide for implementing the use of the improved back.

It is yet a further object to provide such a back that is adaptable to a range of widths of the section of body to be spanned.

These and other objects are attained with the ornamental jewelry assembly of the present invention. It is to be understood throughout that, although the term earring is utilized in the following description, any decorative ornament for use in a pierced body part is intended to be encompassed thereby.

The ornamental jewelry assembly is intended for insertion into a pierced body part. The assembly comprises an earring post that has a notch adjacent its back end and a length that is sufficient to span the pierced body part. The post additionally has means for affixing a decorative object to its front end thereof The assembly further comprises an earring back, which includes a generally cylindrical tube that has an open front end that is dimensioned to admit the earring post thereinto. The earring back also has a notch adjacent the front end. The notch is positioned and dimensioned to provide a friction fit between the tube and the post and also to engage the post notch. The notch is also intended to provide an indication to a wearer that the post and the tube have mated sufficiently to retain the post within the tube.

The earring back additionally includes a generally flat disc that is affixed to the tube's back end of the tube generally at a right angle. The disc is preferably dimensioned to prevent passage into a pierced hole of an earlobe of the wearer and is also preferably smooth on both faces for the wearer's comfort.

In an alternate embodiment, an ornamental jewelry insertion assembly, there is provided, in addition to the earring back, a post guide for assisting in inserting the back tube into the earlobe hole. The post guide comprises means for gripping at a front end, which is dimensioned to prevent passage into the earlobe hole. Affixed to the back end of the gripping means is a shaft, which is sufficiently long to penetrate through the earlobe hole. The shaft has a notch that is positioned adjacent the front end. The notch is positioned and dimensioned to provide a friction fit between the tube and the shaft and to engage the tube notch. The notch also serves to provide an indication to a wearer that the shaft and the tube have mated sufficiently to retain the tube within the earlobe hole.

This insertion assembly is used by inserting the post guide shaft into the earlobe hole from front to back while holding the gripping means. Next the tube is inserted into the earlobe hole from back to front, so that it surrounds the shaft until the tube notch and the shaft notch are in contact. Then the shaft is removed, leaving the tube in the earlobe hole. Now that the tube is in place in the earlobe, it is easier to insert an earring post.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

Figure 1:
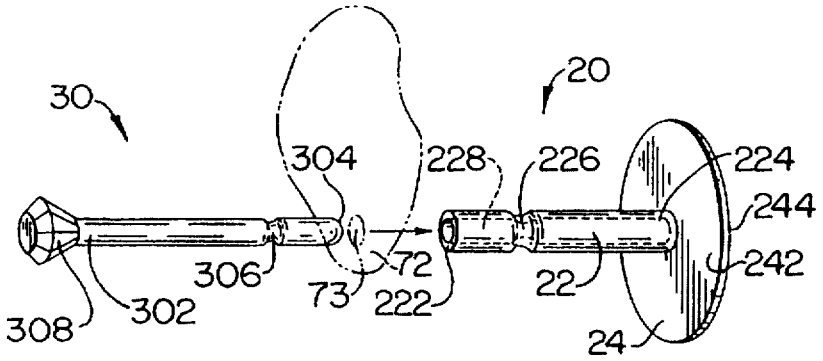
FIG. 1 is a side perspective view of the earring back being mated with an earring post.
Figure 2:
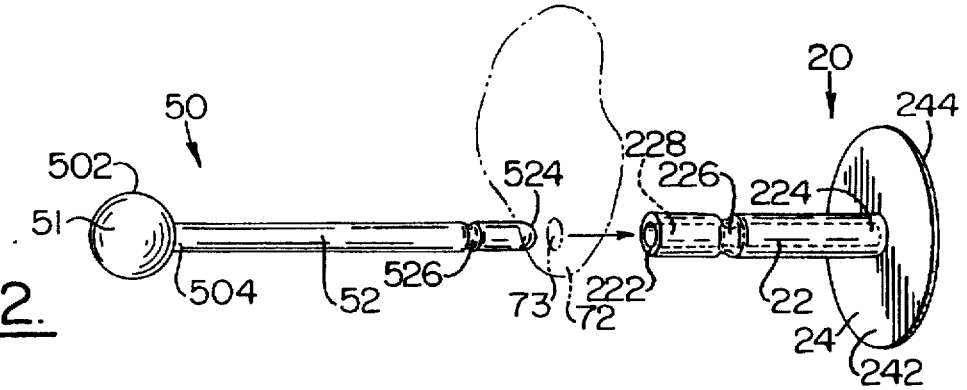
FIG. 2 is a side perspective view of the post guide.
Figure 3:
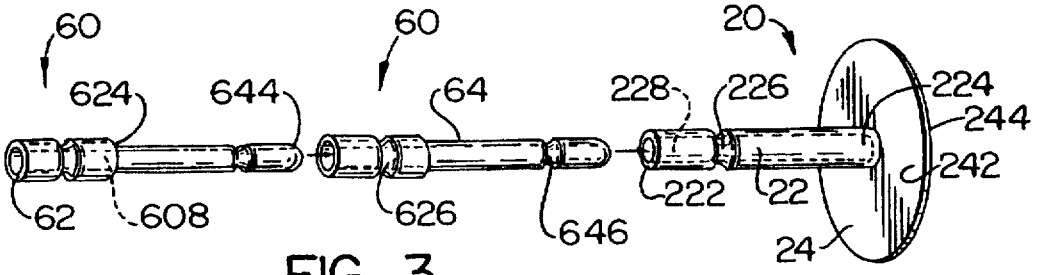
FIG. 3 is a side perspective view of several extension modules being mated with the earring back.

A description of the preferred embodiments of the present invention will now be presented with reference to FIGS. 1–3.

A first embodiment of the invention (FIG. 1) comprises an earring back 20, which is for coupling with an earring post 30 that has a notch 306 adjacent its back end 304. The earring back 20 comprises a generally cylindrical tube 22, which has an open front end 222. The front end 222 is dimensioned to admit the earring post 30 into its bore 228.

The earring back's tube 22 has a notch 226 that is located adjacent the front end 222. The notch 226 is positioned and dimensioned to provide a friction fit between the tube 22 and the post 30 and to engage the post's notch 306. The notches 226,306 also serve to provide an indication to the wearer that the post 30 and the tube 22 have mated sufficiently to retain the post 30 within the tube 22.

The earring back's tube 22 can be made of any suitable material, such as plastic or a hypoallergenic metal.

The earring back 20 also comprises a generally flat disc 24 that is affixed to the back end 224 of the tube 22. The disc 24 is typically affixed so that the tube 22 is in the disc's center and is generally normal thereto. Preferably the disc 24 has smooth front 242 and back 244 sides, in order to maximize the comfort of the wearer. The disc 24 should be dimensioned to prevent passage into the pierced hole 73 of the wearer's earlobe 72.

A second embodiment (FIG. 1), which is an ornamental jewelry assembly, includes, in addition to the back 20 as described above, the post section 30, which has notch 306 adjacent its back end 304. The length of the post 30 should be sufficient to span the pierced body part, in FIG. 1 shown as an earlobe 72, although this is not intended to be a limitation. In a preferred embodiment, the length of the post 30 can be shorter than that of a conventional post, with the disc 24 having no hole therethrough. In this case the post 30 thus does not protrude through the disc 24 as in conventional earring assemblies, which provides increased comfort to the wearer under conditions in which the earlobe 72 may be pressed against the head, such as while sleeping.

The post 30 also has means for affixing a decorative object to its front end 302. As shown, such a decorative object may comprise a gemstone 308.

A third embodiment of the invention (FIG. 2) is intended for use by people who may have difficulty manipulating a post-back assembly. This embodiment includes a post guide 50, which is used for assisting in inserting the back tube into the earlobe hole. The post guide 50 comprises means for gripping at a front end 502 that is dimensioned to prevent passage into the earlobe hole. In a particular embodiment, the gripping means comprises a ball-shaped member 51, but this is not intended as a limitation.

A shaft 52 is affixed to the back end 504 of the ball-shaped member 51. The shaft 52 has a length that is sufficient to penetrate through the earlobe hole, and in a preferred embodiment is significantly longer than that earlobe hole passage, in order to provide sufficient extra length to aid the wearer in positioning the back tube 22.

A notch 526 is positioned to be adjacent the shaft's front end 524. The shaft's notch 526 is positioned and dimensioned to provide a friction fit between the tube 22 and the shaft 52, and to engage the tube's notch 226. The notch 526 further serves to provide an indication to the wearer that the shaft 52 and the tube 22 have mated sufficiently to retain the tube 22 within the earlobe hole.

In use, then the post guide's shaft 52 is inserted into the earlobe hole from front to back while holding the ball-shaped member 51. Next the tube 22 is inserted into the earlobe hole so that it surrounds the shaft 52 and extends sufficiently far that the tube's 226 and the shaft's 526 notches are in contact. Then the shaft 52 is removed from the earlobe hole, leaving the tube 22 in the earlobe hole. Finally, an earring post 30 may be inserted and affixed to the tube 22 as described above.

Another embodiment of the invention comprises, in addition to the above-discussed earring back 20, an extension member 60 (FIG. 3). The extension member 60, or a plurality thereof, can be used to adjust for earlobes and/or body parts that are wider than the extent of the post-tube assembly. The extension member 60 has a longitudinal bore 608 therethrough, at least part of which is dimensioned to admit an earring post 30 thereinto.

In a specific embodiment, the extension member 60 comprises a front tubular portion 62 that has a diameter generally commensurate with the diameter of the earring back's tube 22. The front tubular portion 62 also has a notch 626 that is adjacent the back end 624 and is positioned and dimensioned to provide a friction fit between the tubular portion 62 and the earring's post 30. This notch 626 is for engaging the post's notch 306 and for providing an indication to the wearer that the post 30 and the tubular portion 62 have mated sufficiently to retain the post 30 within the tubular portion 62.

The extension member 60 further comprises a generally cylindrical back snap portion 64. The back snap portion 64 has a length and diameter dimensioned for insertion into the earring back tube 22. The back snap portion 64 additionally has a notch 646 that is adjacent the back end 644. The notch 646 is positioned and dimensioned to provide a friction fit between the back snap portion 64 and the earring back tube 22 and to engage the earring back tube notch 226. Thus it can be seen that one or more extension members 60 can be interposed between the earring post 30 and the earring back 20 in order to easily custom fit a comfortable assembly for wearing. This embodiment is not intended to be limiting, and can easily be adapted to other pierced body parts where extension is required.

It has also been found that the design of the earring fastening system of the present invention can serve to prevent or permit the healing of infections, since there is no protrusion behind the ear that can catch on the wearer's hair or clothing, which can irritate the pierced hole.

It may be appreciated by one skilled in the art that additional embodiments may be contemplated, including attachment systems for other types of decorative jewelry.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. An adjustable-length earring back assembly for coupling with an earring post having a notch adjacent a back end thereof, the assembly comprising:

an earring back comprising:

a generally cylindrical tube having:

an open front end; and a notch adjacent the front end;

a generally flat disc affixed to a back end of the tube generally normal thereto, the disc dimensioned to prevent passage into a pierced hole of an earlobe of the wearer;

an extension member having a longitudinal bore therethrough dimensioned to admit an earring post thereinto and comprising:

a front tubular portion having:

a diameter generally commensurate with a diameter of the earring back tube; and a notch adjacent a back end positioned and dimensioned to provide a friction fit between the tubular portion and the post, to engage the post notch, and to provide an indication to a wearer that the post and the tubular portion have mated sufficiently to retain the post within the tubular portion;

a generally cylindrical back snap portion having:

a length and diameter dimensioned for insertion into the earring back tube; and a notch adjacent a back end positioned and dimensioned to provide a friction fit between the back snap portion and the earring back tube and to engage the earring back tube notch.

* * * * *